US012031789B1

(12) United States Patent
Helms et al.

(10) Patent No.: US 12,031,789 B1
(45) Date of Patent: Jul. 9, 2024

(54) BOLT-ACTION FOR A FIREARM

(71) Applicants: Donald Ray Helms, Pisgah Forest, NC (US); Kenneth William Ey, Lake Havasu City, AZ (US)

(72) Inventors: Donald Ray Helms, Pisgah Forest, NC (US); Kenneth William Ey, Lake Havasu City, AZ (US)

(73) Assignee: Microtech Defense Industries, Inc., Mills River, NC (US)

( * ) Notice: Subject to any disclaimer, the term of this patent is extended or adjusted under 35 U.S.C. 154(b) by 0 days.

(21) Appl. No.: 18/457,801

(22) Filed: Aug. 29, 2023

(51) Int. Cl.
*F41A 3/22* (2006.01)
*F41A 3/66* (2006.01)

(52) U.S. Cl.
CPC . *F41A 3/22* (2013.01); *F41A 3/66* (2013.01)

(58) Field of Classification Search
USPC ..... 42/16, 17
See application file for complete search history.

(56) References Cited

U.S. PATENT DOCUMENTS

| | | | | |
|---|---|---|---|---|
| 11,300,374 | B1 | 4/2022 | Tritsch | |
| 11,662,174 | B1 | 5/2023 | McLeod | |
| 11,774,198 | B2 * | 10/2023 | Plebani | F41A 3/70 42/69.02 |
| 2022/0099391 | A1 | 3/2022 | Koehler et al. | |
| 2022/0163275 | A1 | 5/2022 | Ballard et al. | |
| 2022/0299280 | A1 * | 9/2022 | Sunseri | F41A 3/72 |
| 2022/0390196 | A1 | 12/2022 | Baumbach | |
| 2023/0003471 | A1 | 1/2023 | Kohli | |
| 2023/0014919 | A1 | 1/2023 | Karagias | |
| 2023/0083435 | A1 | 3/2023 | Quinn | |
| 2023/0213296 | A1 | 7/2023 | Underwood et al. | |
| 2023/0228520 | A1 | 7/2023 | Bellitti et al. | |

* cited by examiner

*Primary Examiner* — Reginald S Tillman, Jr.
(74) *Attorney, Agent, or Firm* — Steve LeBlanc, LLC

(57) ABSTRACT

A bolt-action for a firearm includes a receiver that defines a chamber having a longitudinal axis and a breech end of the receiver. A bolt is at least partially inside the chamber and slidingly engaged with the receiver. The bolt has a locked position that prevents movement of the bolt parallel to the longitudinal axis of the chamber and an unlocked position that allows movement of the bolt parallel to the longitudinal axis of the chamber. A spring under compression is operably engaged with the bolt to bias the bolt away from the breech end of the receiver.

19 Claims, 3 Drawing Sheets

BOLT-ACTION FOR A FIREARM

FIELD OF THE INVENTION

The present invention generally involves a bolt-action for a firearm. Particular embodiments of the present invention may be incorporated into a handgun, a shotgun, or a rifle.

BACKGROUND OF THE INVENTION

Many designs exist for firearms such as handguns, shotguns, and rifles. Each firearm design generally includes a receiver, a barrel, and a trigger. The receiver provides a chamber for holding a cartridge before and after firing, and a breech end of the receiver connects to the barrel. The barrel provides a cylindrical path for a projectile to travel from the breech end of the receiver, through the barrel, and out a muzzle end of the barrel. Operation of the trigger releases a firing pin to strike the cartridge and ignite a propellant. Ignition of the propellant generates combustion gases that propel the projectile from the breech end of the receiver, through the barrel, and out the muzzle end of the barrel. A magazine containing multiple cartridges may connect to the receiver, and a bolt or slide may be slidingly engaged with the receiver to extract and eject the fired cartridge before stripping the top-most cartridge from the magazine for insertion into the receiver.

A bolt-action firearm includes a rotating bolt or a straight pull bolt. A rotating bolt must be rotated at the beginning and end of each cycle, whereas a straight pull bolt may simply be cycled without rotating. In either design, the bolt is opened by pulling the bolt away from the breech end of the receiver to extract and eject a previously fired cartridge. The bolt cocks the firing pin either on opening or closing of the bolt, depending on the particular design, and as the bolt is moved toward the breech end of the receiver to a closed position, the bolt strips the top-most cartridge from the magazine and seats the new cartridge in the breech end of the receiver. The bolt then locks in the closed position, and the firearm is ready for firing.

The particular design for a bolt-action firearm balances multiple and often competing design goals. For example, the bolt must be manually reciprocated with respect to the receiver to cycle the bolt-action—i.e., eject the previously fired cartridge, cock the firing pin, strip the top-most cartridge from the magazine, and seat the new cartridge into the breech end of the receiver—and it is generally desirable to minimize the amount of force needed to fully cycle the bolt-action to facilitate smooth and rapid cycling of the bolt. However, the small amount of force needed to cycle the bolt-action may result in inadvertent movement of the bolt from the open position. For example, a user may place the firearm in a safe position for transport by fully opening the bolt to extract any cartridge from the receiver, but jostling or simply tilting the firearm downward may cause the bolt to inadvertently leave the fully open position, resulting in the bolt partially or fully loading a new cartridge into the receiver. As a result, the need exists for an improved bolt-action for a firearm that reduces the ability for the bolt to inadvertently leave the open position.

BRIEF DESCRIPTION OF THE INVENTION

Aspects and advantages of the invention are set forth below in the following description, or may be obvious from the description, or may be learned through practice of the invention.

One embodiment of the present invention is a bolt-action for a firearm that includes a receiver that defines a chamber having a longitudinal axis and a breech end of the receiver. A bolt is at least partially inside the chamber and slidingly engaged with the receiver to move parallel to the longitudinal axis of the chamber. The bolt-action further includes a means for biasing the bolt away from the breech end of the receiver and parallel to the longitudinal axis of the chamber.

An alternate embodiment of the present invention is a bolt-action for a firearm that includes a receiver that defines a chamber having a longitudinal axis and a breech end of the receiver. A bolt is at least partially inside the chamber and slidingly engaged with the receiver. The bolt has a locked position that prevents movement of the bolt parallel to the longitudinal axis of the chamber and an unlocked position that allows movement of the bolt parallel to the longitudinal axis of the chamber. A spring under compression is operably engaged with the bolt to bias the bolt away from the breech end of the receiver.

In yet another embodiment of the present invention, a bolt-action for a firearm includes a receiver that defines a chamber and a breech end of the receiver. A bolt is at least partially inside the chamber and slidingly engaged with the receiver. A spring is under compression between the bolt and the receiver to bias the bolt away from the breech end of the receiver.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
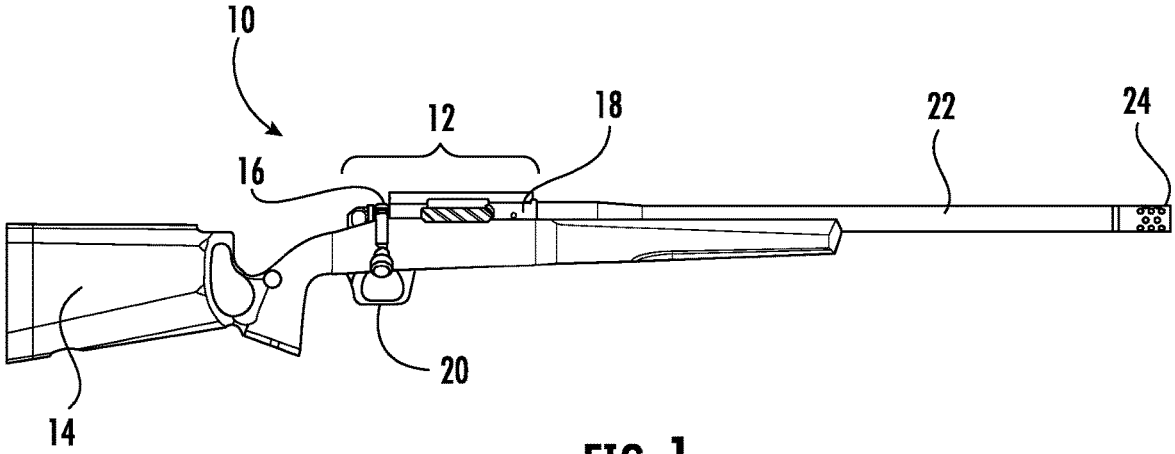
FIG. 1 is a side plan view of an exemplary bolt-action firearm having a bolt-action within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a bolt-action for a firearm that biases a bolt in the bolt-action to an open position to reduce the ability for the bolt to inadvertently leave the open position. In particular embodiments of the present invention, the firearm may be a handgun, a shotgun, or a rifle, and the bolt may be a rotating bolt or a straight pull bolt with either a centerfire or rim fire firing pin. The present invention is not limited to any particular firearm, bolt design, or firing mechanism unless specifically recited in the claims.

FIG. 1 provides a side plan view of an exemplary bolt-action firearm 10 having a bolt-action 12 within the scope of the present invention. As shown in FIG. 1, the firearm 10 generally includes a stock 14, a bolt 16, a receiver 18, a trigger 20, and a barrel 22, as is generally known in the art. The stock 14 provides a convenient support for handling and shouldering the firearm 10. The bolt 16 reciprocates with respect to the receiver 18 to cock a firing pin and load and lock a cartridge in the receiver 18. The trigger 20 releases the firing pin to strike the cartridge and ignite propellant in the cartridge to propel a projectile through the barrel 22 and out a muzzle end 24 of the barrel 22.

Figure 2:
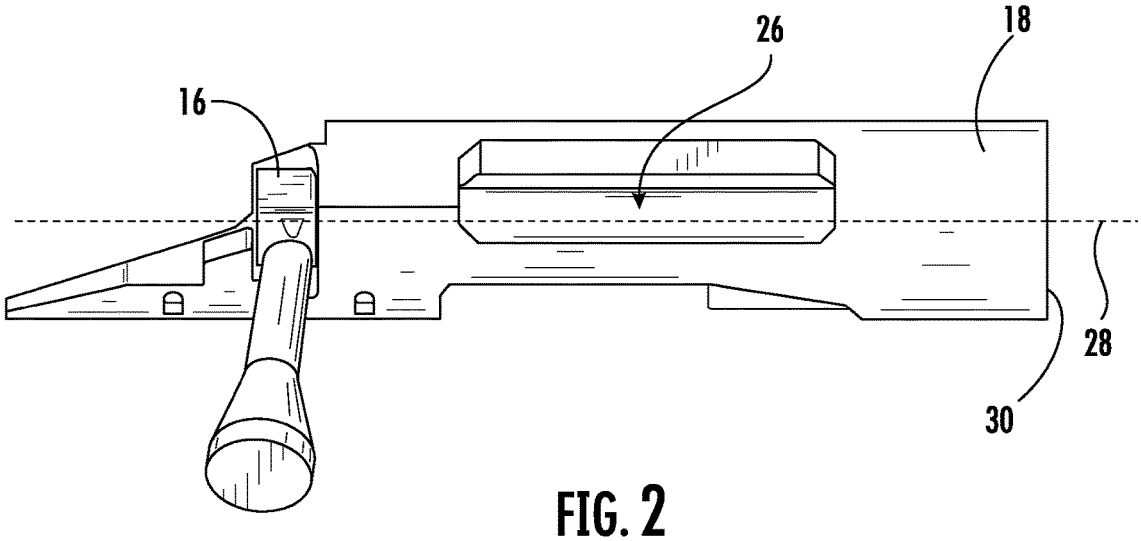
FIG. 2 is an enlarged view of the bolt-action shown in FIG. 1 with the bolt in a locked position.
Figure 3:
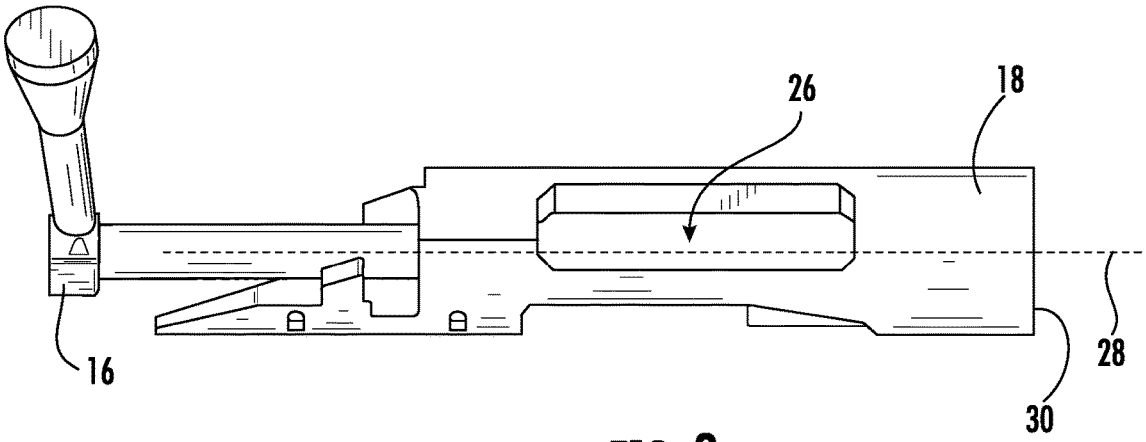
FIG. 3 is an enlarged view of the bolt-action shown in FIG. 1 with the bolt in an unlocked position.

FIGS. 2 and 3 provide enlarged views of the bolt-action 12 shown in FIG. 1 with the bolt 16 in the locked and unlocked positions, respectively. As used herein, the term "bolt-action" refers to the combination of the bolt 16 and the receiver 18. The bolt 16 and receiver 18 may be forged or cast from steel or other sufficiently strong metal to withstand the explosive transients associated with the firing sequence. As shown in FIGS. 2 and 3, the receiver 18 defines a chamber 26 having a longitudinal axis 28. A breech end 30 of the receiver 18 engages with the barrel 22 by threads, press fit, a latch, or other suitable mechanical connection known to one of ordinary skill in the art. The receiver 18 may be any shape that provides a desired external appearance and accommodates the various components involved in the firing sequence of the firearm 10. In particular embodiments, for example, the receiver 18 may be forged or cast as a cylinder to reduce the manufacturing costs. However, the particular shape of the receiver 18 is not a limitation of the present invention unless recited in the claims.

The bolt 16 is at least partially inside the chamber 26 and slidingly engaged with the receiver 18 to move parallel to the longitudinal axis 28 of the chamber 26 to alternately position the cartridge in the chamber 26 for firing or extract and eject the cartridge from the chamber 26 after firing. As shown in FIGS. 2 and 3, the bolt 16 rotates with respect to the receiver 18 to move between the locked and unlocked positions. The locked position, shown in FIG. 2, prevents movement of the bolt 16 parallel to the longitudinal axis 28 of the chamber 26. The unlocked position, shown in FIG. 3, allows movement of the bolt 16 parallel to the longitudinal axis 28 of the chamber 26.

The bolt-action 12 further includes a means for biasing the bolt 16 away from the breech end 30 of the receiver 18 and parallel to the longitudinal axis 28 of the chamber 26. The function of the means is to bias or move the bolt 16 away from the breech end 30 of the receiver 18 and parallel to the longitudinal axis 28 of the chamber 26. The structure for performing this function may be any mechanical, electro-mechanical, hydraulic, or pneumatic device that can impart a force on the bolt 16 away from the breech end 30 of the receiver 18. For example, permanent or electro-magnets may be positioned on the bolt 16 and/or receiver 18 to impart magnetic attraction or repulsion to bias the bolt 16 away from the breech end 30 of the receiver 18. Alternately, a hydraulic or pneumatic piston may be engaged with the bolt 16 to apply force on the bolt 16 away from the breech end 30 of the receiver 18. In a still further embodiment, a spring may be engaged with the bolt 16 to force the bolt 16 away from the breech end 30 of the receiver 18.

Figure 4:
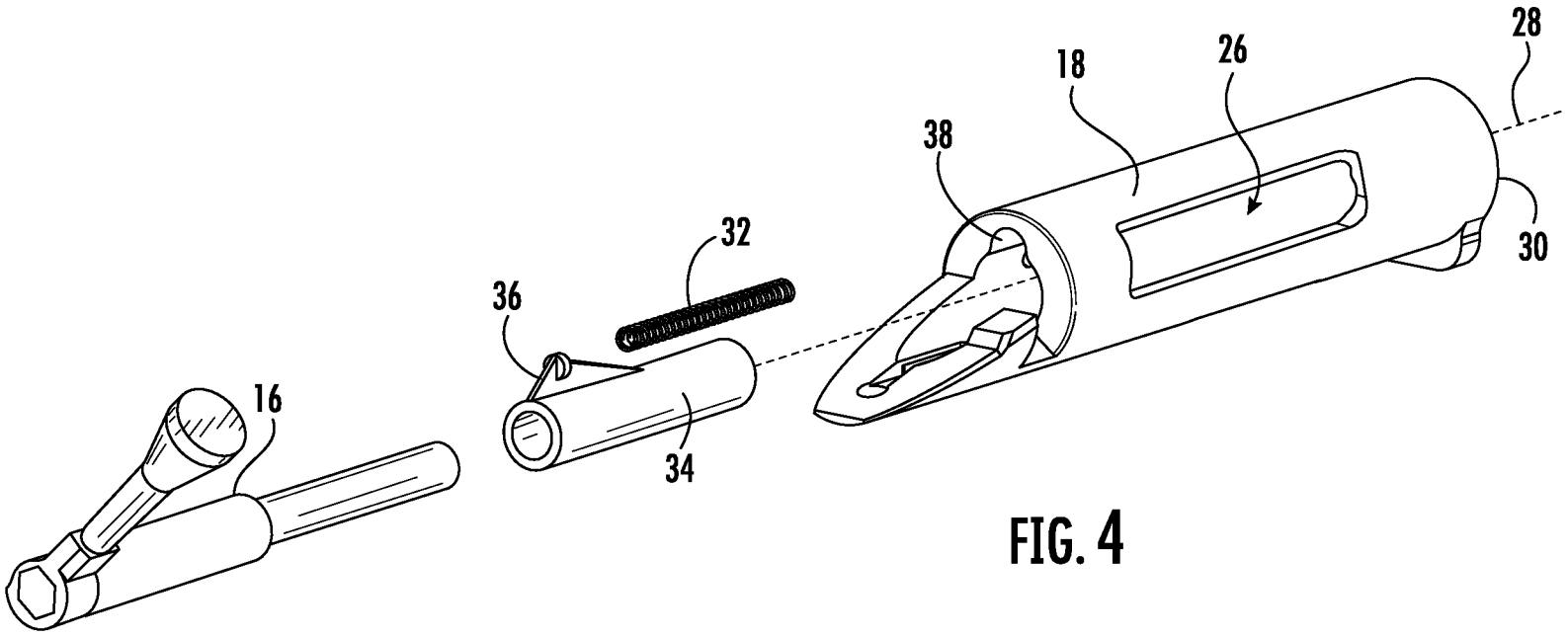
FIG. 4 is an exploded rear perspective view of the bolt-action shown in FIGS. 2 and 3 according to one embodiment of the present invention.

FIG. 4 provides an exploded rear perspective view of the bolt-action 12 shown in FIGS. 2 and 3 according to one embodiment of the present invention. In this particular embodiment, the means for biasing the bolt 16 away from the breech end 30 of the receiver 18 and parallel to the longitudinal axis 28 of the chamber 26 is a spring 32 under compression and operably engaged with the bolt 16. The spring 32 may engage directly with a flange or projection that extends radially from the bolt 16 to bias the bolt 16 away from the breech end 30 of the receiver 16. Alternately, as shown in FIG. 4, a sleeve 34 may surround at least a portion of the bolt 16 and rotate with respect to the bolt 16. A flange 36 extending from the sleeve 34 may operably engage with the spring 32 under compression so that the spring 32 applies force to the sleeve 34, and thus the bolt 16, away from the breech end 30 of the receiver 16.

As further shown in FIG. 4, the receiver 18 may include a groove 38 parallel to the longitudinal axis 28 to house and protect the spring 32. In this manner, the flange 36 extending from the sleeve 34 may slide parallel to the longitudinal axis 28 in the groove 38 as the bolt 16 slides with respect to the receiver 18, and the spring 32 applies force to the flange 36 extending from the sleeve 34 to bias the bolt 16 away from the breech end 30 of the receiver 18 parallel to the longitudinal axis 28 of the chamber 26.

Figure 5:
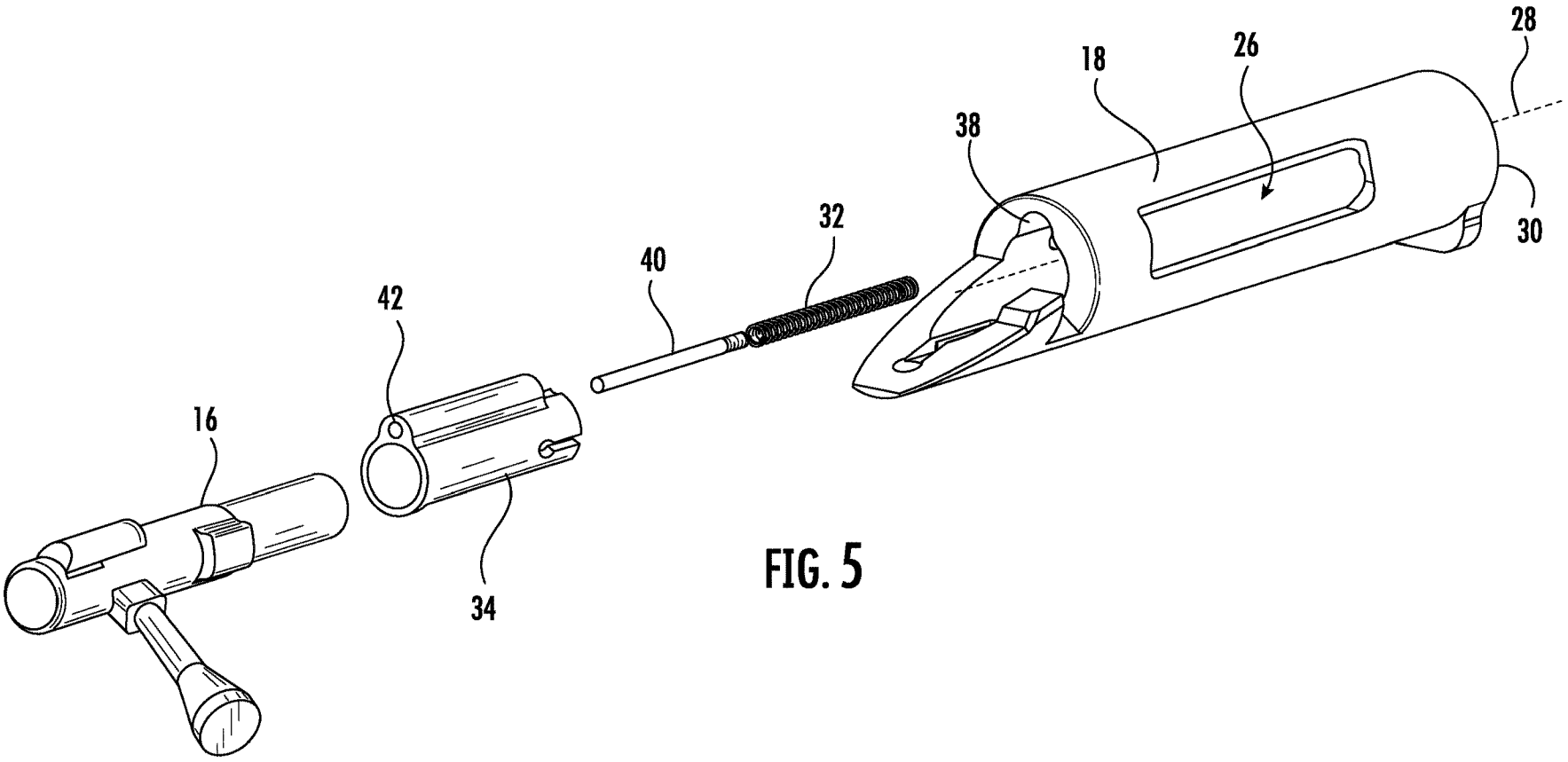
FIG. 5 is an exploded rear perspective view of the bolt-action shown in FIGS. 2 and 3 according to an alternate embodiment of the present invention.

FIG. 5 provides an exploded rear perspective view of the bolt-action 12 shown in FIGS. 2 and 3 according to an alternate embodiment of the present invention. The bolt-action 12 again includes the bolt 16, receiver 18, and sleeve 34 as previously described with respect to FIG. 4, and the spring 32 again provides the means for biasing the bolt 16 away from the breech end 30 of the receiver 18 and parallel to the longitudinal axis 28 of the chamber 26. In addition, the bolt-action 12 further includes a rod 40 and an enclosure 42 defined on the sleeve 34. The rod 40 is inserted longitudinally through the spring 32 under compression, and the enclosure 42 receives the spring 32 and rod 40 to maintain the axial alignment between the spring 32 and the sleeve 34. In this manner, the spring 32 applies force to the enclosure 42 on the sleeve 34 to bias the bolt 16 away from the breech end 30 of the receiver 18 parallel to the longitudinal axis 28 of the chamber 26.

The various embodiments of the bolt-action 12 described and illustrated with respect to FIGS. 1-5 thus enhance the safe operation of the firearm 10 by biasing the bolt 16 away from the breech end 30 of the receiver 18 to reduce inadvertent cycling of the bolt 16.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A bolt-action for a firearm, comprising:
a receiver that defines a chamber having a longitudinal axis;
a breech end of the receiver;
a bolt at least partially inside the chamber and slidingly engaged with the receiver to move parallel to the longitudinal axis of the chamber; and
a means for biasing the bolt away from the breech end of the receiver and parallel to the longitudinal axis of the chamber.

2. The bolt-action for the firearm as in claim 1, wherein the means for biasing the bolt away from the breech end of the receiver and parallel to the longitudinal axis of the chamber comprises a spring under compression and operably engaged with the bolt.

3. The bolt-action for the firearm as in claim 2, further comprising a rod inserted longitudinally through the spring under compression.

4. The bolt-action for the firearm as in claim 2, further comprising a groove in the receiver, and the spring under compression is positioned at least partially in the groove in the receiver.

5. The bolt-action for the firearm as in claim 2, further comprising a sleeve that surrounds at least a portion of the bolt and can rotate with respect to the bolt, wherein the sleeve is operably engaged with the spring under compression.

6. The bolt-action for the firearm as in claim 5, further comprising an enclosure defined on the sleeve that receives the spring under compression.

7. The bolt-action for the firearm as in claim 1, wherein the bolt rotates with respect to the receiver.

8. A bolt-action for a firearm, comprising:
a receiver that defines a chamber having a longitudinal axis;
a breech end of the receiver;
a bolt at least partially inside the chamber and slidingly engaged with the receiver, wherein the bolt has a locked position that prevents movement of the bolt parallel to the longitudinal axis of the chamber and an unlocked position that allows movement of the bolt parallel to the longitudinal axis of the chamber; and
a spring under compression and operably engaged with the bolt to bias the bolt away from the breech end of the receiver.

9. The bolt-action for the firearm as in claim 8, further comprising a rod inserted longitudinally through the spring under compression.

10. The bolt-action for the firearm as in claim 8, further comprising a groove in the receiver, and the spring under compression is positioned at least partially in the groove in the receiver.

11. The bolt-action for the firearm as in claim 8, further comprising a sleeve that surrounds at least a portion of the bolt and can rotate with respect to the bolt, wherein the sleeve is operably engaged with the spring under compression.

12. The bolt-action for the firearm as in claim 11, further comprising an enclosure defined on the sleeve that receives the spring under compression.

13. The bolt-action for the firearm as in claim 8, wherein the bolt rotates with respect to the receiver to move between the locked and unlocked positions.

14. A bolt-action for a firearm, comprising:
a receiver that defines a chamber;
a breech end of the receiver;
a bolt at least partially inside the chamber and slidingly engaged with the receiver; and
a spring under compression between the bolt and the receiver to bias the bolt away from the breech end of the receiver.

15. The bolt-action for the firearm as in claim 14, further comprising a rod inserted longitudinally through the spring under compression.

16. The bolt-action for the firearm as in claim 14, further comprising a groove in the receiver, and the spring under compression is positioned at least partially in the groove in the receiver.

17. The bolt-action for the firearm as in claim 14, further comprising a sleeve that surrounds at least a portion of the bolt and can rotate with respect to the bolt, wherein the sleeve is operably engaged with the spring under compression.

18. The bolt-action for the firearm as in claim 17, further comprising an enclosure defined on the sleeve that receives the spring under compression.

19. The bolt-action for the firearm as in claim 14, wherein the bolt rotates with respect to the receiver.

* * * * *